United States Patent [19]

Deason

[11] 4,311,292

[45] Jan. 19, 1982

[54] GUTTER ATTACHMENT

[76] Inventor: Paul K. Deason, 634 Chuck Gray Ct., Owensboro, Ky. 42301

[21] Appl. No.: 129,844

[22] Filed: Mar. 13, 1980

[51] Int. Cl.[3] ..... E04D 13/06

[52] U.S. Cl. ..... 248/48.2; 52/11

[58] Field of Search ..... 248/48.2, 48.1; 52/11, 52/12, 14, 95

[56] References Cited

U.S. PATENT DOCUMENTS

| | | | |
|---|---|---|---|
| 531,989 | 1/1895 | Anorews | 52/16 |
| 2,125,928 | 8/1938 | Knerr . | |
| 2,624,299 | 1/1953 | Beegle | 52/16 |
| 2,989,822 | 6/1961 | Dunn | 52/95 X |
| 3,077,055 | 2/1963 | Tripp . | |
| 3,091,055 | 5/1963 | Hegedusich . | |
| 4,019,290 | 4/1977 | Manty | 52/11 |
| 4,072,285 | 2/1978 | Greenwood | 248/48.2 |
| 4,199,121 | 4/1980 | Febvre | 248/48.2 |

FOREIGN PATENT DOCUMENTS

| | | | |
|---|---|---|---|
| 703314 | 2/1965 | Canada | 248/48.2 |

*Primary Examiner*—J. Franklin Foss

*Attorney, Agent, or Firm*—Victor J. Evans & Co.

[57] ABSTRACT

Disclosed herein is a mechanism for attaching a gutter to the bottom portion of a roof so as to carry water away therefrom comprising an L-shaped bracket having a vertical and a horizontal leg, a hinged member attached to the horizontal leg at an extremity remote from the vertical leg and a releaseable fastener on the top portion of the vertical leg adapted to cooperate with a pop rivet disposed on the gutter. The gutter is hinged to the horizontal leg of the L-shaped bracket and affixed by the pop rivet to the fastener so that it can releaseably removed from the bracket and tipped over to remove the contents of the gutter which typically takes the form of leaves and other forms of debris.

2 Claims, 2 Drawing Figures

FIG. 1
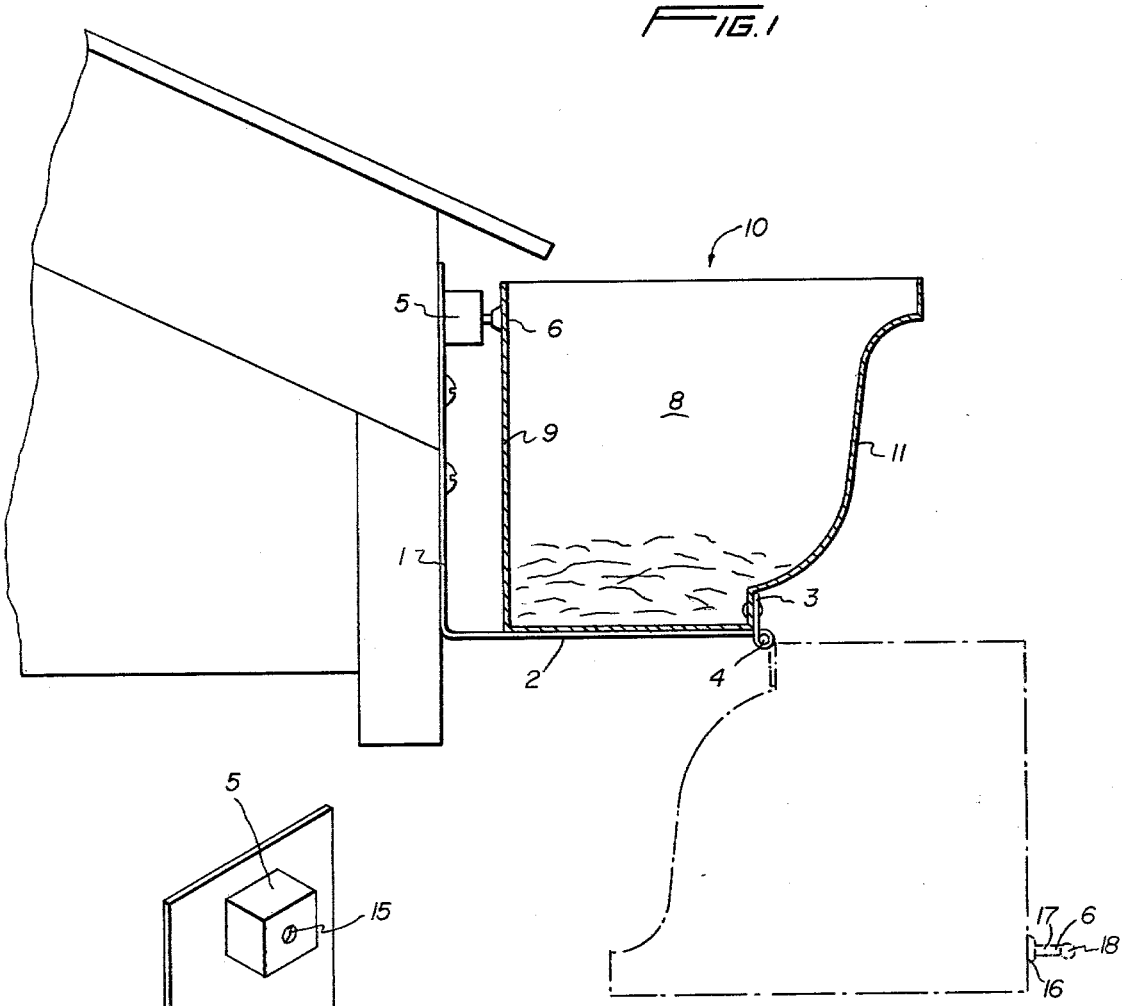
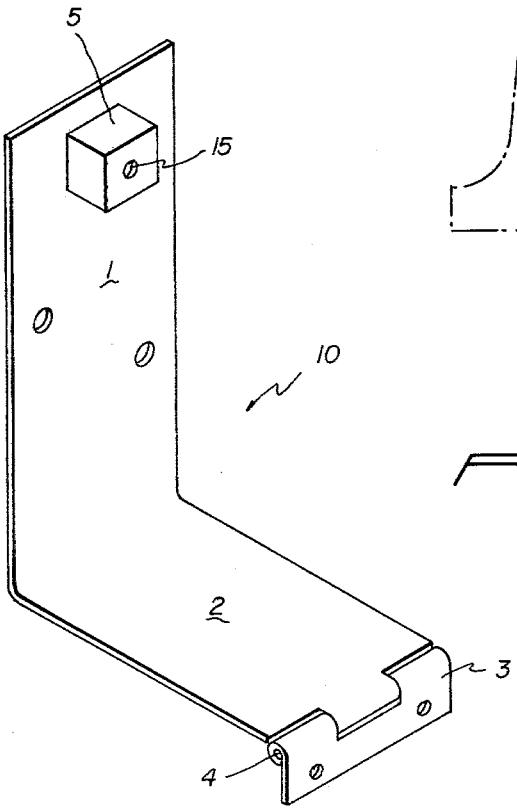
FIG. 2

GUTTER ATTACHMENT

BACKGROUND OF THE INVENTION

Cleaning gutters around a house has become a seasonal chore that is necessary in order to assure the proper functioning of the gutter, and a manual cleaning thereof can be quite laborious. Various prior art devices which attempt to reduce the amount of labor include the following prior art devices:

U.S. Pat. No. 531,989, Andrews

U.S. Pat. No. 2,125,928, Knerr

U.S. Pat. No. 2,624,299, Beegle

U.S. Pat. No. 3,077,055, Tripp, Jr.

U.S. Pat. No. 3,091,055, Hegedusich

Curiously, all of these mechanisms can be characterized by their complexity and therefor the associated cost in initially installing them, and the likelihood of failures rendering system inoperable due to the plurality of components.

For example, Tripp provides a nonstanderized circular trough which is fashioned to reside in a bearing support from which extends the downspout the performance of which is controlled by a chain extending down the building.

Andrews provides a gutter attachment in which the gutter is pivoted at its bottom extremity through a linkage system connected near the ground level through a rod whereby actuation of the lever system causes the gutter to rotate inwardly towards the house, and as shown in FIG. 3 is not likely to provide a complete emptying of the debris within the gutter. Further, the downspount system at the area of interconnection must have a flared enlarged terminal portion to allow for the rotation period.

Similarly, Hegedusich provides a system of considerable complexity requiring a biasing element and a four bar linkage provided with a plurality of adjustments to allow the rain gutter bracket to become reoriented.

The remaining references show the state of the art further.

Clearly, none of the references provides a system for the expeditious removal of debris from a gutter which is relatively inexpensive to manufacture, and reliable in use. Further distinctions can be appreciated by considering the ensuing discussion of the instant invention.

SUMMARY AND OBJECTIVES OF THE INVENTION

Accordingly, an objective of this invention is to provide a cleanable gutter which is relatively inexpensive, reliable, and easy to clean.

A further object of this invention is to provide a gutter of the character described above and support mechanism therefor which requires few moving parts which could be detrimentally affected by the weather.

These and other objects will be made manifest when considering the following detailed description of the invention when taken in conjunction with the appended drawing figures.

BRIEF DESCRIPTION OF THE DRAWINGS

FIG. 1 is a side view of the apparatus according to the present invention.

FIG. 2 is a perspective view of the hinged structure therefor.

BRIEF DESCRIPTION OF THE PREFERRED EMBODIMENT

Referring to the drawings now, wherein like reference numerals refer to like parts, reference numeral 10 is directed to the gutter support according to the present invention.

This gutter support 10 may generally be regarded as being provided with a vertical leg 1 having plural holes therethrough for fastening to the side of a building directly underneath the roof. Integral therewith is a horizontal leg 2 extending outwardly from the building which terminates in a hinged portion 3 having a pivot point 4 (FIG. 2). The top extremity of the vertical leg 1 remote from the horizontal leg 2 is provided with a friction type block latch 5 having a hole on a face thereof for the reception of a pop rivet 6.

The pop rivet 6 is attached to the back face 9 of a gutter 8 having an arcuate front wall 11 and a plainer bottom edge of the arcuate wall 11 hinges to the horizontal leg 2 of the L-shaped bracket. The pop rivet 6 is provided with a base portion 16 from which extends an elongate shaft 17 and a rounded protuberance 18 having a greater dimension than the shaft 17. The protuberance 18 is forced within the hole 15 on the latch 5 and the diameter of the hole 15 approximates that of the dimension of 17 so that a slight deformation of the latch 5 occurs when the protuberance 18 is inserted therein.

In use and operation, the gutter is forced from the latch 5 so that the pop rivet is removed therefrom, and the gutter is allowed to pivot around the hinge pivot area 4 thereby dumping the debris that is accumulated therein. For reinsertion, the gutter is merely rotated back in a counter-clockwise fashion as shown in the figure and the rivet reinserted into the latch 5.

Having thus described the invention, it is apparent that numerous structural modifications are contemplated as being a part of this invention as specified herein above and as delineated herein below by the claims.

What is claimed is:

1. A gutter support bracket which allows the gutter to rotate about a point and therefore clean the gutter of accumulated debris comprising an L-shaped bracket member having a vertical leg affixed to the wall of the building directly underneath the roof and a horizontal leg extending outwardly therefrom, pivot means disposed on the horizontal leg at an extremiter remote from the vertical leg, latching means disposed on the vertical leg and on the gutter to fasten said vertical leg to the gutter and in which said latching means comprises a block latch disposed on a vertical leg of the bracket having means defining an opening on a face of said latch proximate to the gutter and a pop rivet disposed on a wall of the gutter in registry with the hole on said latch.

2. The device of claim 1 wherein said pop rivet comprises a base an elongate shaft eminating from said base and a rounded protuberance having a greater dimension than the width of the shaft.

* * * * *